US007455061B2

(12) United States Patent
Morgan et al.

(10) Patent No.: US 7,455,061 B2
(45) Date of Patent: Nov. 25, 2008

(54) BUBBLE DIVERTER FOR USE WITH DIVING EQUIPMENT

(75) Inventors: William B. Morgan, Santa Barbara, CA (US); Connie L. Morgan, Santa Barbara, CA (US); Trent M. Schultz, Goleta, CA (US)

(73) Assignee: Kirby Morgan Dive Systems, Inc., Santa Barbara, CA (US)

( * ) Notice: Subject to any disclaimer, the term of this patent is extended or adjusted under 35 U.S.C. 154(b) by 498 days.

(21) Appl. No.: 11/231,462

(22) Filed: Sep. 21, 2005

(65) Prior Publication Data

US 2007/0062524 A1 Mar. 22, 2007

(51) Int. Cl.

| | |
|---|---|
| ***B63C 11/02*** | (2006.01) |
| ***B63C 11/12*** | (2006.01) |
| ***B63C 11/14*** | (2006.01) |
| ***A63B 33/00*** | (2006.01) |

(52) U.S. Cl. ..... 128/200.29; 128/200.24; 128/201.15

(58) Field of Classification Search ..... 128/200.29, 128/200.24, 201.1, 201.15, 201.11
See application file for complete search history.

(56) References Cited

U.S. PATENT DOCUMENTS

| | | | | |
|---|---|---|---|---|
| 3,568,672 | A * | 3/1971 | Cupp | 128/200.29 |
| 3,721,235 | A * | 3/1973 | Ball et al. | 128/205.22 |
| 4,467,797 | A * | 8/1984 | Franke | 128/204.26 |
| 4,527,657 | A | 7/1985 | Payne | |
| 4,527,658 | A * | 7/1985 | Payne | 181/235 |
| 4,856,120 | A | 8/1989 | Hart | |
| 5,159,923 | A * | 11/1992 | Kaburaki | 128/201.27 |
| 5,329,643 | A | 7/1994 | Sato | |
| 5,575,277 | A | 11/1996 | Lutz et al. | |
| 5,860,168 | A | 1/1999 | Winefordner et al. | |
| 6,644,307 | B2 | 11/2003 | Morgan et al. | |
| 2002/0129818 | A1 * | 9/2002 | Morgan et al. | 128/206.26 |
| 2003/0066789 | A1 * | 4/2003 | Morgan et al. | 210/120 |
| 2004/0035415 | A1 * | 2/2004 | Faligant | 128/201.27 |

* cited by examiner

*Primary Examiner*—Justine R Yu
*Assistant Examiner*—Clinton Ostrup
(74) *Attorney, Agent, or Firm*—Cislo & Thomas, LLP

(57) ABSTRACT

A diving helmet bubble diverter comprises a front skirt portion and a rear skirt portion attached to the front skirt portion at one end. The rear skirt portion is configured for mounting onto the diving helmet breathing regulator assembly. The attached front and rear skirt portions form side pockets that divert exhaust air bubbles away from the diver's mask when the rear skirt portion is mounted onto the regulator assembly. The mounted rear skirt portion forms a protective barrier between the exterior wall of the diving helmet and the exhaust whisker of the breathing regulator assembly that prevents air bubbles exiting the whisker from coming into contact with the diving helmet during diving activities.

21 Claims, 5 Drawing Sheets

BUBBLE DIVERTER FOR USE WITH DIVING EQUIPMENT

BACKGROUND

Diving equipment typically includes a diving mask generally covering the eyes and nose of the user and a breathing regulator assembly. The breathing regulator assembly includes a mouthpiece that is connected via a hose to a carry-on air tank. Diving equipment comes in a variety of configurations including FFMs (Full Face Masks), diving helmets, SCUBA (Self Contained Underwater Breathing Apparatus) and/or the like.

One problem currently existing with conventional diving equipment is that underwater breathing creates exhaust air bubbles and attendant noise that may interfere with the diver's vision and ability to communicate. Most air bubbles are exhausted as the diver exhales through a rubber one-way valve that is mounted in the breathing regulator. The exhaust air bubbles tend to travel upward in front of and around the diver's face and head, ending up in front of the eyes and/or traveling past the diver's cheeks, ears and temple area either directly or on the outside of a FFM mask frame or helmet shell obstructing the diver's vision and communication abilities including the diver's auditory ability.

This is especially true when a diver is positioned underwater with the top of his/her head towards the water surface, and looking forward or up, as the air bubbles generally ascend upward along the diver's face, mask frame or helmet shell. Consequently, divers have come to accept exhaust air bubbles as part of the diving experience. To avoid air bubble interference some divers may try to position themselves with their heads facing downward or tilted to one side, or they may hold their breath when trying to hear during diving communications. Apart from being an inconvenience, this positioning may not always be possible especially when divers ascend and have to look up to ensure that they do not collide with object(s) above them.

SUMMARY

Exemplary embodiments disclosed herein are generally directed to a bubble diverter for use with diving equipment. The diving equipment includes in part a breathing regulator assembly and a diver's mask.

In accordance with one aspect of the invention, the bubble diverter comprises a front skirt portion and a rear skirt portion. The rear skirt portion is attached to the front skirt portion at one end and adapted for mounting onto the breathing regulator assembly. The attached front and rear skirt portions form at least one side pocket adapted to divert exhaust air bubbles away from the diver's mask during diving activities when the rear skirt portion is mounted onto the breathing regulator assembly. The mounted rear skirt portion forms a protective barrier adapted to prevent air bubbles exiting the breathing regulator assembly from coming into contact with the diving equipment.

This and other aspects of the invention will become apparent from a review of the accompanying drawings and the following detailed description of the invention.

BRIEF DESCRIPTION OF THE DRAWINGS

The present invention is generally shown by way of reference to the accompanying drawings in which.

DETAILED DESCRIPTION

The detailed description set forth below in connection with the appended drawings is intended as a description of exemplary embodiments and is not intended to represent the only forms in which the exemplary embodiments may be constructed and/or utilized. The description sets forth the functions and the sequence of steps for constructing and operating the exemplary embodiments in connection with the illustrated embodiments. However, it is to be understood that the same or equivalent functions and sequences may be accomplished by different embodiments that are also intended to be encompassed within the spirit and scope of the present invention.

Some embodiments of the present invention will be described in detail with reference to a diving helmet bubble deflector, as generally shown in FIGS. 3-6. Additional embodiments, features and/or advantages of the invention will become apparent from the ensuing description or may be learned by practicing the invention. In the figures, the drawings are not to scale with like numerals referring to like features throughout both the drawings and the description.

Figure 1:
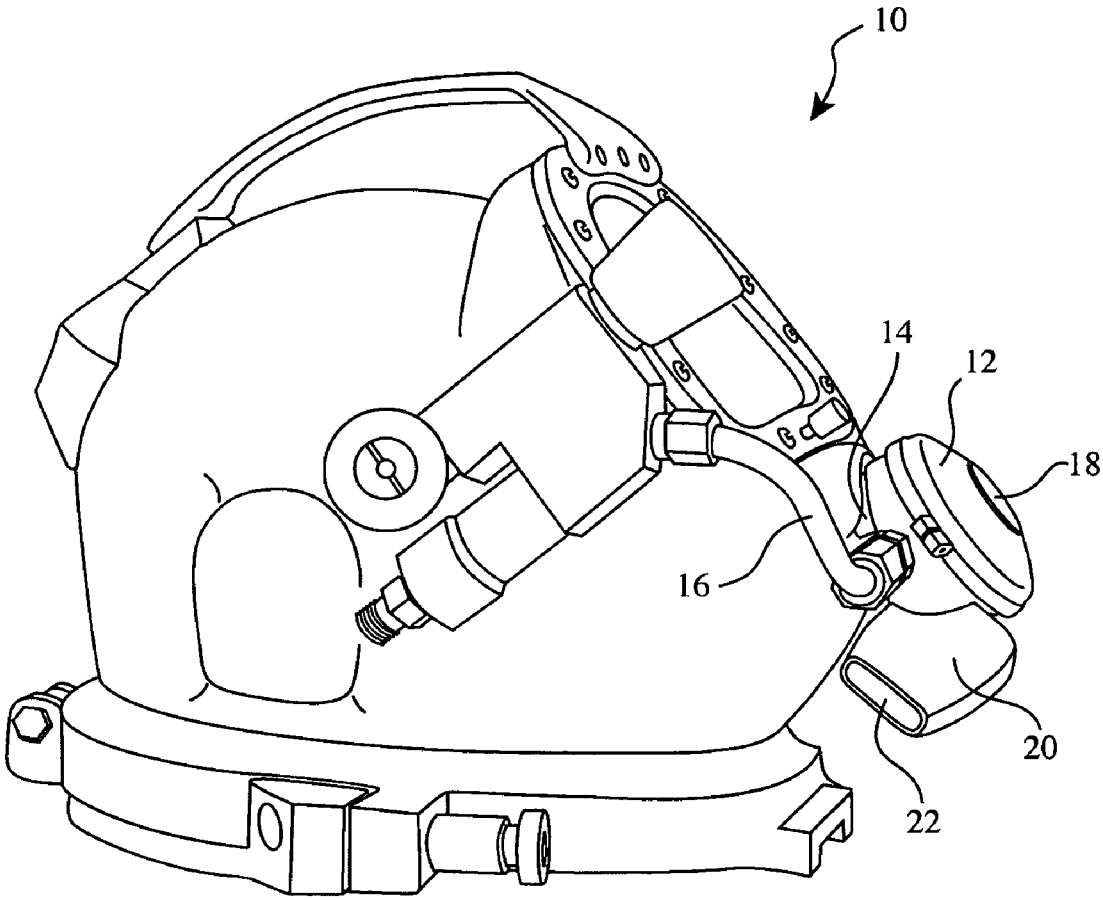
FIG. 1 is a side perspective view of a conventional diving helmet.
Figure 2:
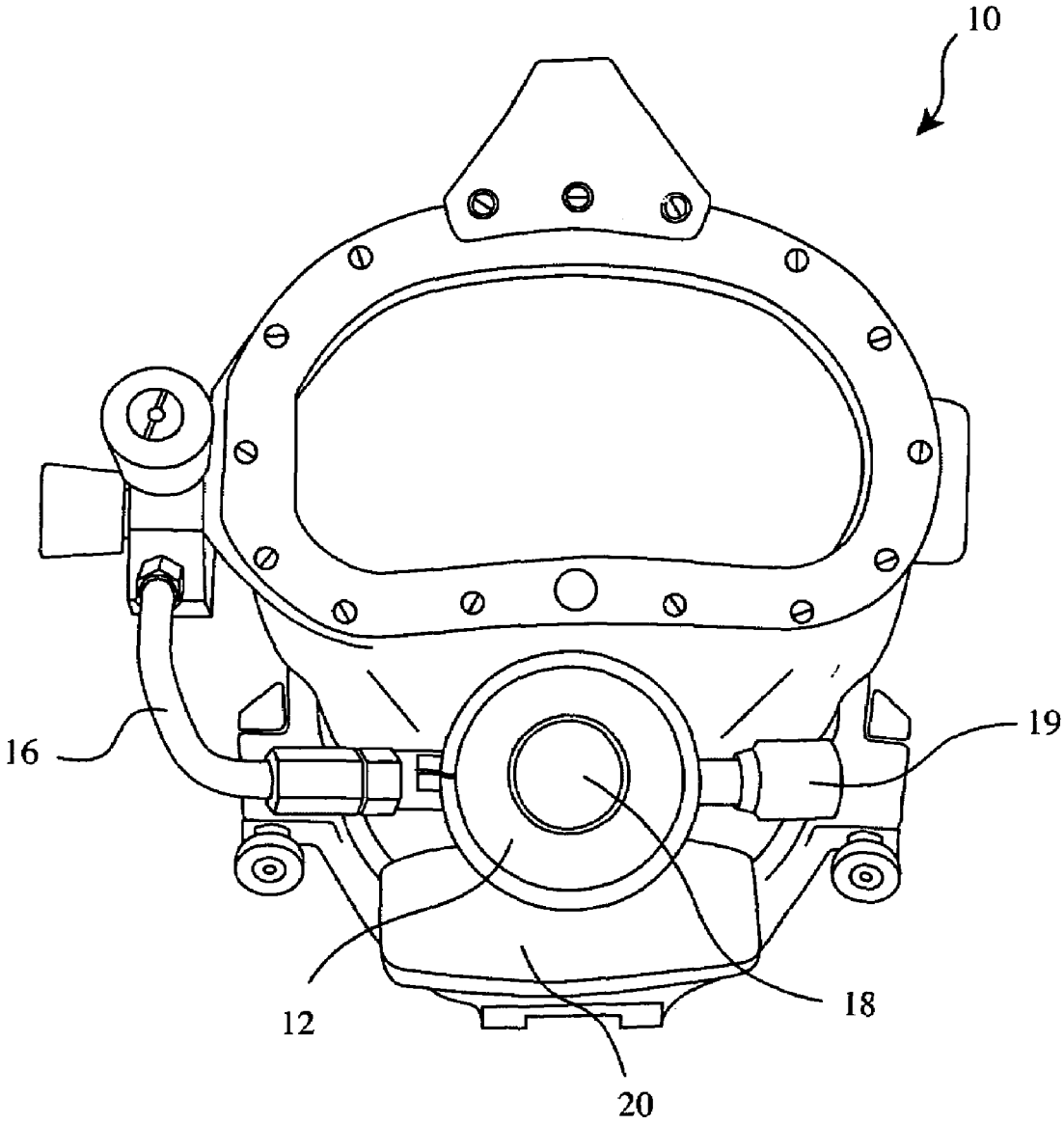
FIG. 2 is a front perspective view of the diving helmet of FIG. 1.

FIG. 1 is a side perspective view of a conventional diving helmet 10 provided with a breathing regulator assembly 12 operatively coupled between a breathing regulator mount tube 14 and an air supply tube 16 (FIGS. 1-2). Breathing regulator assembly 12 includes in part an air release or purge button 18 (FIGS. 1-2), a breathing regulator adjustment knob 19 (FIG. 2) and an exhaust whisker 20 (FIGS. 1-2). Whisker 20 lets exhaust air out as bubbles via outlet 22 (FIG. 1). The exhaust air bubbles tend to travel upwards, i.e. toward water surface 50 (FIGS. 5-6), generally blocking the diver's vision. If the diver is looking slightly downward the exhaust air bubbles tend to travel along the sides of diving helmet 10 generating audible noise inside diving helmet 10 which distracts the diver during communication with other divers and/or support crew above water.

Figure 3:
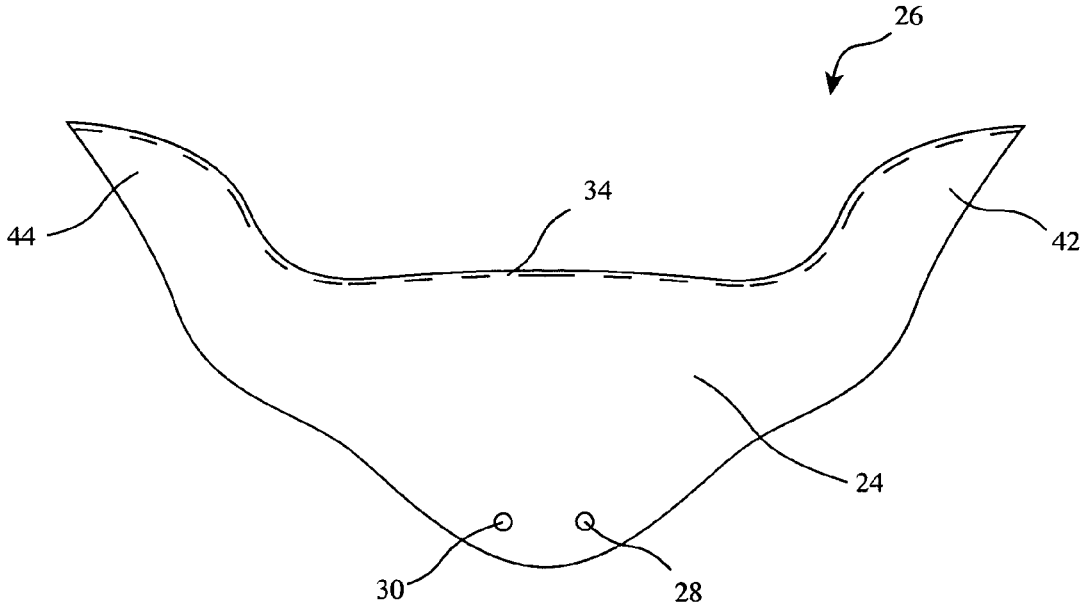
FIG. 3 is a top plan view of a front skirt portion of a diving helmet bubble deflector pattern in accordance with an exemplary embodiment of the present invention.

FIG. 3 is a top plan view of a generally bird-like front skirt portion 24 of a diving helmet bubble deflector pattern 26 in accordance with an exemplary embodiment of the present invention. Front skirt portion 24 is provided at one end with a pair of apertures 28, 30 adapted for mounting weight(s) which keep the bottom portion of the skirt from rising up due to buoyancy and/or exhaust bubble flow and blocking the diver's view during diving activities such as when the diver is in a face forward or face up position. In this regard, FIG. 6 generally shows a front weight 32 mounted in accordance with the present invention to decrease buoyancy and maintain proper positioning of the skirt during diving activities.

Front skirt portion 24 may be constructed from flexible materials such as rubber, neoprene, silicone, urethane, cloth and/or the like. Front skirt portion 24 may also be constructed from a combination of rigid and flexible materials, as needed. In one embodiment, front skirt portion 24 may be made of relatively thin and transparent flexible material. Front skirt portion 24 includes a generally curvilinear top edge 34 (FIG. 3).

Figure 4:
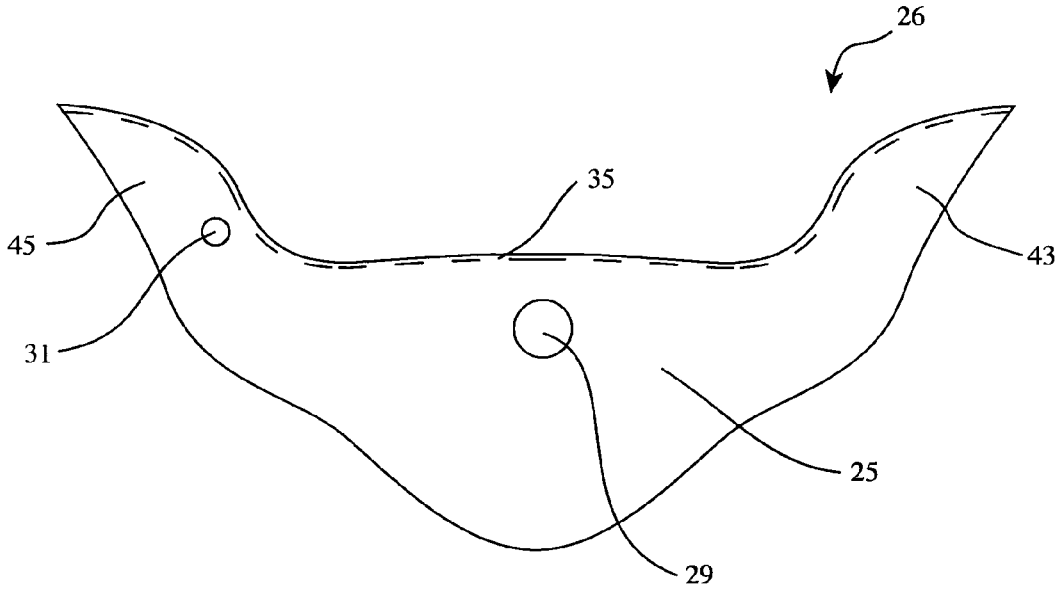
FIG. 4 is a top plan view of a rear skirt portion of a diving helmet bubble deflector pattern in accordance with another exemplary embodiment of the present invention.

FIG. 4 is a top plan view of a generally bird-like rear skirt portion 25 of a diving helmet bubble deflector pattern 26 in accordance with another exemplary embodiment of the present invention. Rear skirt portion 25 is provided with a breathing regulator mount tube aperture 29 and an air supply tube aperture 31, as generally depicted in FIG. 4. Rear skirt portion 25 may be constructed from flexible materials such as rubber, neoprene, silicone, cloth and/or the like. Rear skirt portion 25 may be also constructed from a combination of rigid and flexible materials, as needed. In one embodiment, rear skirt portion 25 may be made of relatively thin and transparent flexible material. Rear skirt portion 25 has a top edge 35 (FIG. 4) that generally follows the contours of top edge 34 of front skirt portion 24 (FIG. 3).

Construction of a diving helmet bubble deflector in accordance with the present invention includes attaching top edge 35 (FIG. 4) of rear skirt portion 25 to top edge 34 (FIG. 3) of front skirt portion 24 and mounting weight 32 (FIG. 6) to front skirt portion 24. Attachment of top edges 34, 35 may include gluing, sewing, molding and/or the like. Top edges 34, 35 may also be removably attached via a hook-and-loop fasteners, such as those commonly sold under the trademark VELCRO®, and the like. Attached top edges 34, 35 form generally a crease 33 along which front skirt portion 24 is folded over rear skirt portion 25.

Figure 5:
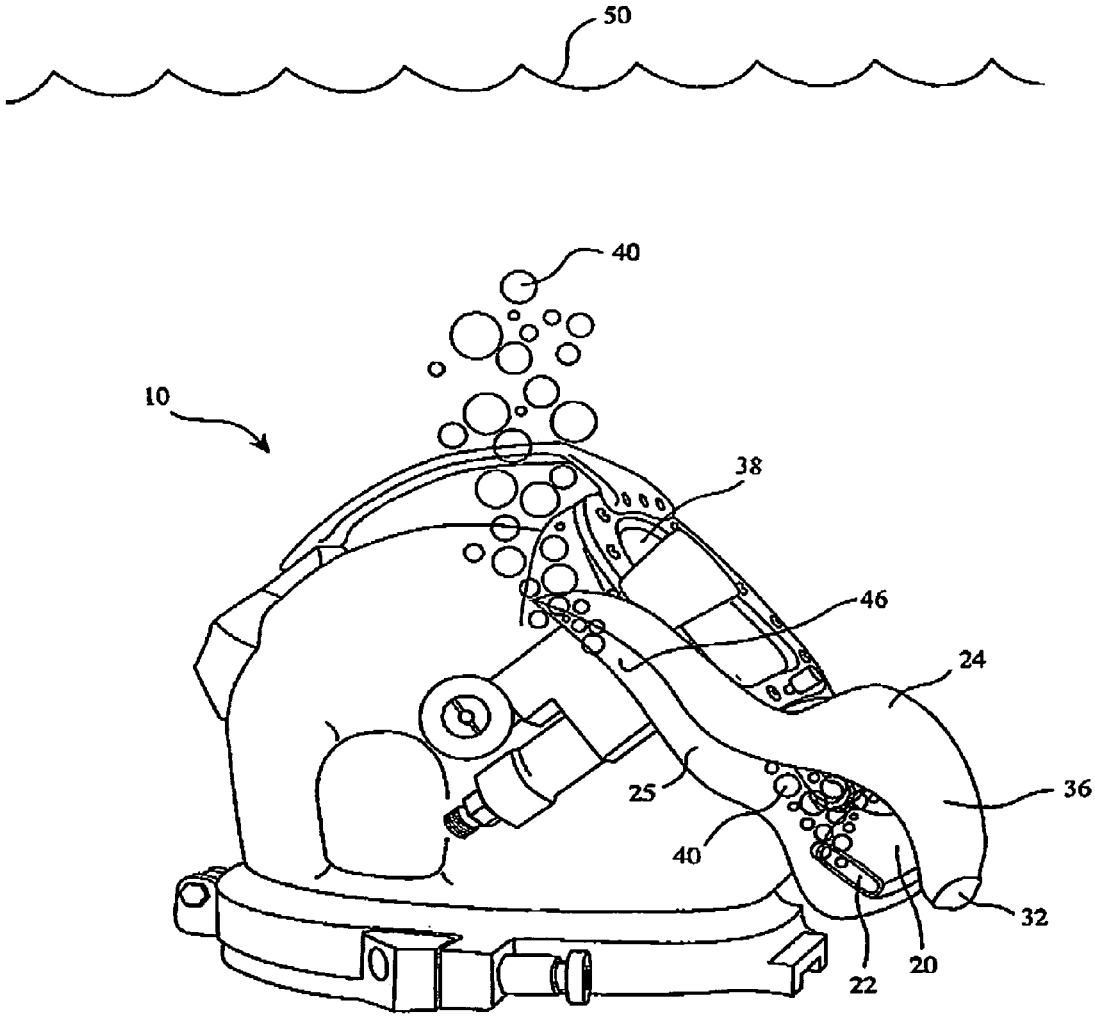
FIG. 5 is a side perspective view of a conventional diving helmet being equipped with a bubble deflector constructed in accordance with the present invention.
Figure 6:
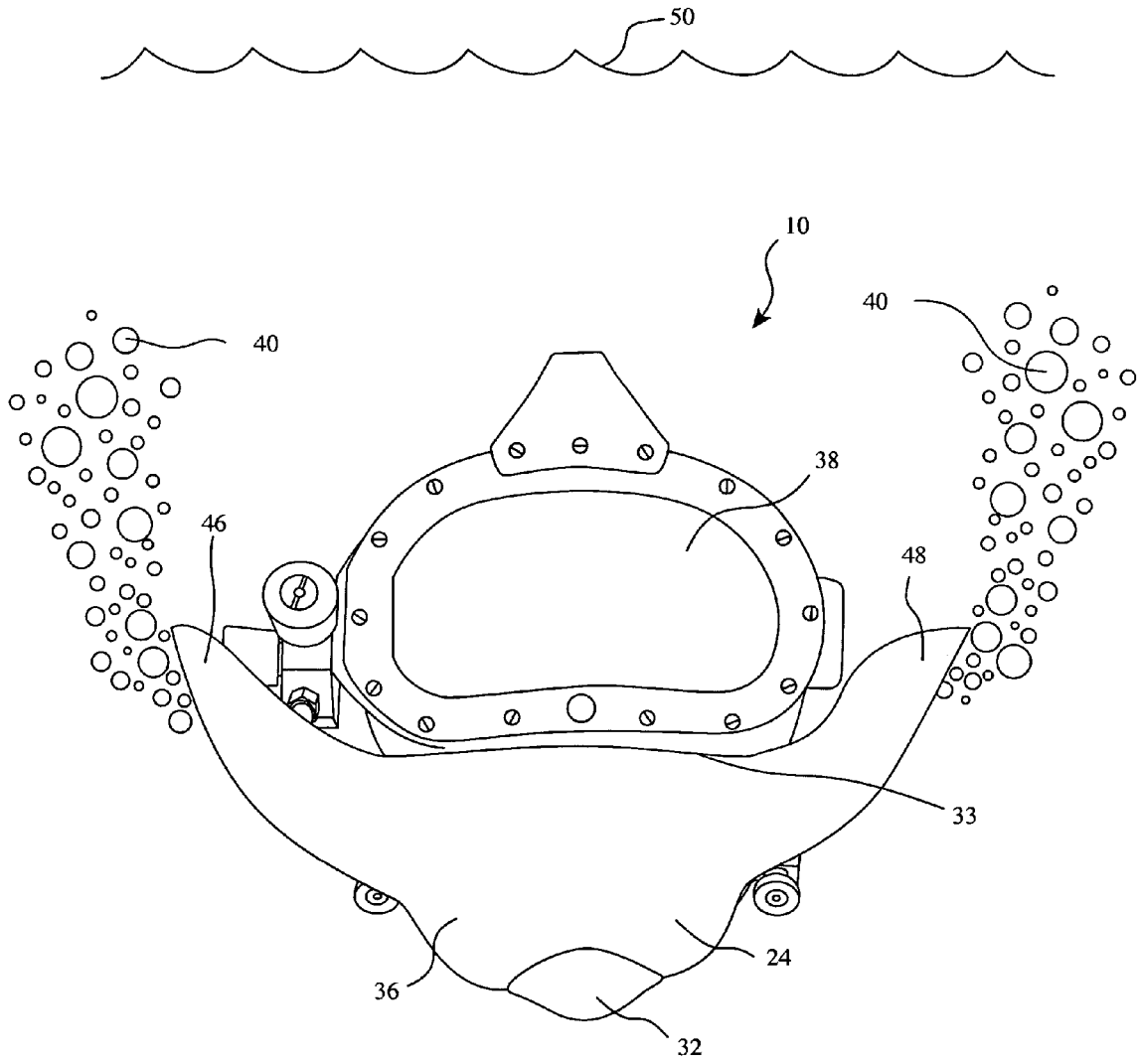
FIG. 6 is a front perspective view of the diving helmet and bubble deflector combination of FIG. 5 in accordance with the present invention.

A bubble deflector 36 constructed in accordance with the present invention and mounted under the viewing lens 38 of diving helmet 10 is generally depicted in reference to FIGS. 5-6. Bubble deflector 36 may be mounted to diving helmet 10 by uncoupling breathing regulator mount tube 14 and air supply tube 16 (FIGS. 1-2) from breathing regulator assembly 12 (FIG. 1), inserting the uncoupled breathing regulator mount tube 14 and air supply tube 16 (FIGS. 1-2) into breathing regulator mount tube aperture 29 and air supply tube aperture 31 of rear skirt portion 25 (FIG. 4), respectively, and re-coupling breathing regulator mount tube 14 and air supply tube 16 (FIGS. 1-2) to breathing regulator assembly 12.

The mounted bubble deflector (36) partially encloses exhaust whisker 20 (FIGS. 1-2) capturing air bubbles 40 exiting whisker 20 (FIG. 5). Specifically, the inserted rear skirt portion (25) forms a protective barrier between the exterior wall of diving helmet 10 and outlet 22 of exhaust whisker 20 which prevents air bubbles 40 exiting whisker 20 from coming into contact with diving helmet 10, as generally illustrated in FIGS. 5-6. The bubble noise commonly experienced by divers using known diving apparatuses is thus eliminated. Moreover, terminal ends 42, 43, 44 and 45 (FIGS. 3-4) of attached front and rear skirt portions 24, 25 form side pockets 46 and 48, respectively, which divert exiting air bubbles 40 outward away from diver's viewing lens 38 and helmet 10 toward water surface 50, as generally shown in reference to FIGS. 5-6. The diverted air bubbles (40) advantageously do not obstruct the diver's vision during various diving activities. Mounted bubble deflector 36 also advantageously provides easy access for the diver to purge button 18 (FIGS. 1-2) through flexible front skirt portion 24 as well as to breathing regulator adjustment knob 19 (FIG. 2) which may be conveniently reached under front skirt portion 24, as generally depicted in FIG. 6.

A person skilled in the art would readily appreciate that the bubble deflector of the present invention may be adapted for use with a full face mask (FFM), SCUBA (Self Contained Underwater Breathing Apparatus) diving equipment and/or the like. The bubble deflector of the present invention may be assembled in other ways and/or with other suitable components and/or materials, as long as there is no departure from the intended purpose and scope of the present invention. The exemplary embodiments described hereinabove are merely illustrative of the general principles of the present invention. Various design modifications may be employed that would reside within the scope of the invention. Thus, by way of example, but not of limitation, alternative configurations may be utilized in accordance with the teachings herein. Accordingly, the drawings and description are illustrative and not meant to be a limitation thereof.

Moreover, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Thus, it is intended that the invention cover all embodiments and variations thereof as long as such embodiments and variations come within the scope of the appended claims and their equivalents.

What is claimed is:

1. A bubble diverter for use with diving equipment including a breathing regulator assembly having an exhaust whisker and a diver's mask having a viewing lens, said bubble diverter comprising:

a. a front skin portion; and b. a rear skirt portion attached to said front skirt portion at one end and adapted for mounting the breathing regulator assembly onto said rear skirt portion, wherein said exhaust a whisker is positioned in between said front skirt portion and said rear skirt portion and wherein said exhaust whisker is partially enclosed by said front skirt portion and said rear skirt portion, said front and rear skirt portions forming at least one side pocket adapted to divert exhaust air bubbles away from the viewing lens during diving activities when said rear skirt portion is mounted onto the breathing regulator assembly, said rear skirt portion forming a protective barrier adapted to prevent air bubbles exiting the breathing regulator assembly from coming into contact with the diving equipment, wherein said rear skirt portion further includes at least one aperture positioned at a bottom of said rear skirt portion, configured for receiving an uncoupled breathing regulator mount tube to mount said breathing regulator assembly.

2. The bubble diverter of claim 1, wherein said front skirt portion includes a front top edge that is curvilinear.

3. The bubble diverter of claim 2, wherein said front skirt portion further includes at least one aperture adapted for mounting at least one weight to decrease buoyancy.

4. The bubble diverter of claim 2, wherein said rear skirt portion includes a rear top edge that follows the contours of said front top edge of said front skirt portion.

5. The bubble diverter of claim 4, wherein said front and rear top edges of said front and rear skirt portions, respectively, are attached to form a crease along which said from skirt portion is folded over said rear skirt portion.

6. The bubble diverter of claim 5, wherein said front and rear top edges of said front and rear skirt portions, respectively, are attached via glue.

7. The bubble diverter of claim 5, wherein said front and rear top edges of said front and rear skirt portions, respectively, are sewn together.

8. The bubble diverter of claim 5, wherein said front and rear top edges of said front and rear skirt portions, respectively, are molded together.

9. The bubble diverter of claim 5, wherein said front and rear top edges of said front and rear skin portions, respectively, are removably attached via hook-and-loop fasteners.

10. The bubble diverter of claim 1, wherein each of said front and rear skirt portions is made of flexible material.

11. The bubble diverter of claim 10, wherein said flexible material is selected from the group consisting of rubber, neoprene, silicone, urethane, cloth and a combination thereof.

12. The bubble diverter of claim 1, wherein said front and rear skirt portions are made of flexible and rigid materials.

13. The bubble diverter of claim 1, wherein said protective barrier decreases bubble noise during diving activities.

14. The bubble diverter of claim 1, wherein diverting exhaust air bubbles via said at least one side pocket reduces diver's vision from being obstructed by said exhaust air bubbles during diving activities.

15. The bubble diverter of claim 1, wherein said attached and mourned rear and front skirt portions are configured to provide access to the breathing regulator assembly during diving activities.

16. The bubble diverter of claim 1, wherein said front and rear skirt portions are configured for use with a diving helmet.

17. The bubble diverter of claim 1, wherein said front and rear skirt portions are configured for use with a full face mask (FFM) diving equipment.

18. The bubble diverter of claim 1, wherein said front and rear skin portions are configured for use with SCUBA (Self Contained Underwater Breathing Apparatus) diving equipment.

19. The bubble diverter of claim 1, wherein said front skirt portion is made of transparent flexible material.

20. The bubble diverter of claim 1, wherein said rear skirt portion is made of transparent flexible material.

21. The bubble diverter of claim 1, wherein the rear skirt portion further comprises a second aperture configured to receive an air supply tube.

* * * * *